US006892409B1

(12) United States Patent
Kaup et al.

(10) Patent No.: US 6,892,409 B1
(45) Date of Patent: May 17, 2005

(54) PORTABLE BRIDGE APPARATUS

(76) Inventors: Jillian Marie Kaup, 706 Little Turtle Dr., Fort Recovery, OH (US) 45846-0605; Marc Ramsey Washington, 1401 Lake Washington, Seattle, WA (US) 98122; Jazlyn L. Carvajal, 17A Belmont St., Somerville, MA (US) 02143; Carl Peter Frank, 40 Harrison St., Croton-On-Hudson, NY (US) 10520

( * ) Notice: Subject to any disclaimer, the term of this patent is extended or adjusted under 35 U.S.C. 154(b) by 0 days.

(21) Appl. No.: 10/832,988

(22) Filed: Apr. 27, 2004

(51) Int. Cl.[7] ..... E01O 6/02
(52) U.S. Cl. ..... 14/9; 14/10; 14/14; 14/77.1
(58) Field of Search ..... 14/3–14, 18–23, 14/24–26; 52/639–644

(56) References Cited

U.S. PATENT DOCUMENTS

| | | | | |
|---|---|---|---|---|
| 440,437 | A | 11/1890 | Phillips | |
| 440,490 | A | 11/1890 | Mitchell | |
| 511,605 | A | 12/1893 | Frederick | |
| 595,629 | A * | 12/1897 | Horton | 14/9 |
| 976,074 | A | 11/1910 | Hartman | |
| 1,330,771 | A * | 2/1920 | Tregillus | 14/9 |
| 1,360,931 | A * | 11/1920 | Graves | 52/644 |
| 1,480,882 | A * | 1/1924 | Davidson | 52/644 |
| 1,654,151 | A * | 12/1927 | Tregillus | 52/644 |
| 2,614,512 | A * | 10/1952 | Gross | 52/89 |
| 2,704,522 | A * | 3/1955 | Frieder et al. | 52/641 |
| 3,849,953 | A * | 11/1974 | Cohen | 52/86 |
| 4,062,081 | A | 12/1977 | Ramer | |
| 4,223,506 | A * | 9/1980 | Blair et al. | 52/644 |
| 4,413,369 | A | 11/1983 | Terrien et al. | |
| 5,312,148 | A | 5/1994 | Morgan | |
| 5,325,557 | A | 7/1994 | Penuela | |
| 5,423,101 | A | 6/1995 | Diefendahl et al. | |
| 5,526,544 | A * | 6/1996 | Wiedeck et al. | 14/2.4 |
| 5,791,717 | A | 8/1998 | Reich et al. | |
| 6,526,706 | B1 | 3/2003 | Fowler | |

FOREIGN PATENT DOCUMENTS

| | | |
|---|---|---|
| EP | 000563872 A1 | 10/1993 |
| JP | 02217504 A | 8/1990 |

* cited by examiner

*Primary Examiner*—Robert E. Pezzuto
*Assistant Examiner*—Alexandra K. Pechhold
(74) *Attorney, Agent, or Firm*—Christopher L. Parmelee; Walker & Jocke LPA

(57) ABSTRACT

A bridge is provided with at least five segments connected in series. Each segment includes two opposed ends. The ends of adjacent segments are in pivoting connection with respect to each other. The bridge also comprises a plurality of cables. For each end of each segment, at least one cable extends between the end of the segment and at least one end of at least one other segment. The cables have sufficient sizes, such that when the segments are pivoted to an orientation which forms an upwardly bowed arch, each of the cables extends in a substantially straight line between the ends of the segments. In addition, the segments on the ends of the bridge may be pivoted toward each other to provide slack in the cables, which enables the segments to pivot with respect to each other to form a compact configuration.

20 Claims, 5 Drawing Sheets

PORTABLE BRIDGE APPARATUS

TECHNICAL FIELD

This invention relates to bridges. Specifically this invention relates to a portable bridge capable of being transported in a compact form and capable of supporting humans thereon.

BACKGROUND ART

Bridges are used by people and objects to traverse obstacles. Bridges may include large concrete and metal bridges designed to traverse a large body of water or valley. However, bridges may also include small wooden bridges designed to traverse a small creek or gully. Such bridges, whether large or small, are typically custom built responsive to the requirements of the obstacle being traversed. However, custom-built bridges may require that the builder of the bridge have specialized knowledge and skills regarding the design and construction of the bridge. Such specialized skills may increase the cost of the project and may increase the amount of time to complete the project. Thus there exists a need for a bridge which minimizes the skill level of the person(s) erecting the bridge and minimizes the cost to erect the bridge.

In addition, many bridges must be assembled at the final destination of the bridge. If the bridge is to be placed in a remote location, the persons(s) constructing the bridge may be required to spend considerable amounts of time at the remote location to assemble the bridge. Consequently there exists a need for a method of erecting a bridge which reduces the amount of time it takes for the bridge to be erected.

Further, many bridges require individual components of the bridge to be produced and/or assembled at the destination for the bridge. The production and/or assembly of such components may require the use of tools which require electrical or other forms of power to operate the tools. As the necessary tools and/or power may not be conveniently available at a remote location, there further exists a need for a bridge which minimizes the amount of tools and/or power requirements to erect the bridge at its intended location.

DISCLOSURE OF INVENTION

It is an object of an exemplary form of the present invention to provide a bridge.

It is a further object of an exemplary form of the present invention to provide a bridge for use by pedestrians.

It is a further object of an exemplary form of the present invention to provide a bridge which minimizes the necessary skill level of the persons erecting a bridge.

It is a further object of an exemplary form of the present invention to provide a bridge which minimizes the cost associated with erecting the bridge.

It is a further object of an exemplary form of the present invention to provide a bridge which minimizes the amount of time necessary to erect the bridge.

It is a further object of an exemplary form of the present invention to provide a bridge which minimizes the amount of tools and/or power requirements necessary to erect the bridge.

Further objects of exemplary forms of the present invention will be made apparent in the following Best Modes for Carrying Out Invention and the appended claims.

The foregoing objects may be accomplished in an exemplary embodiment by a bridge which is comprised of a plurality of consecutively linked segments. In a described exemplary embodiment, the bridge may include five segments, with each adjacent pair of segments being in pivoting connection with each other.

In exemplary embodiments, the segments are operative to pivot to enable the bridge to form an upwardly bowed arch. A plurality of cables extend between each end of each segment and at least one other segment end to maintain the arched shape of the bridge. In this described exemplary embodiment, matching sets of cables extend between the ends of the segments on each side of the bridge.

In exemplary embodiments, each adjacent pair of segments may be in operative connection with at least one rod. At least one of the segments may be in pivoting connection with the at least one rod to enable the segments to pivot with respect to each other. In this described exemplary embodiment, the adjacent ends of the segments may overlap and include coaxially aligned holes adapted to receive a common rod therethrough. Bolts, washers and/or other fasteners and/or bracketry may be connected to the rods to prevent the rods from sliding out of engagement with the segments.

Cables may be in operative connection with the opposed ends of each rod. In an exemplary embodiment, the cables may include loops adjacent each end of the cables which are operative to extend around the rods. Washers and nuts may be mounted to the rod adjacent the cables to minimize the cables from sliding in directions parallel to the longitudinal axis of the rods.

In exemplary embodiments each segment may have at least one upper surface capable of supporting the weight of at least one person. In further exemplary embodiments, the cables may be operative to prevent the segments from pivoting with respect to each other in response to the weight of at least one person.

In this described exemplary embodiment, the cables may correspond to steel cables, the rods may correspond to threaded steel rods and the segments may be comprised of parallel wooden beams with apertures at each end for receiving the rods. The upper surface of each segment may be comprised of at least one plank spanning the parallel wooden beams to provide a sufficient surface area for a person to walk on top of the segments and across the bridge. In alternative exemplary embodiments, the segments, rods, and cables may be comprised of other materials which provide the bridge with sufficient structural integrity to support the weight of at least one person thereon. However, it is to be understood that depending on the materials chosen for the segments and cables, and the number of cables, the bridge may be operative to support several thousands of pounds.

In exemplary embodiments, when the segments are orientated in an arch and cables are fully extended, the cables are operative to prevent the segments from pivoting to an orientation which increases the distance between the ends of the outer segments of the bridge. However, the ends of each of the end segments of the bridge may be operative to pivot toward each other to decrease the length of the bridge and provide slack in the cables. In this described exemplary embodiment, the extra slack provided by folding the end segments inwardly may enable the segments to fold into a compacted orientation which is more convenient for transporting the bridge.

In exemplary embodiments, the cables may be attached to the rods when the bridge is in the compacted form. In other exemplary embodiments, the cables may not be attached to the rods when the bridge is in the compacted orientation. In such embodiments, the cables may be attached to the rods when the bridge is folded outwardly to form the previously described upwardly bowed arch.

BEST MODES FOR CARRYING OUT INVENTION

Figure 1:
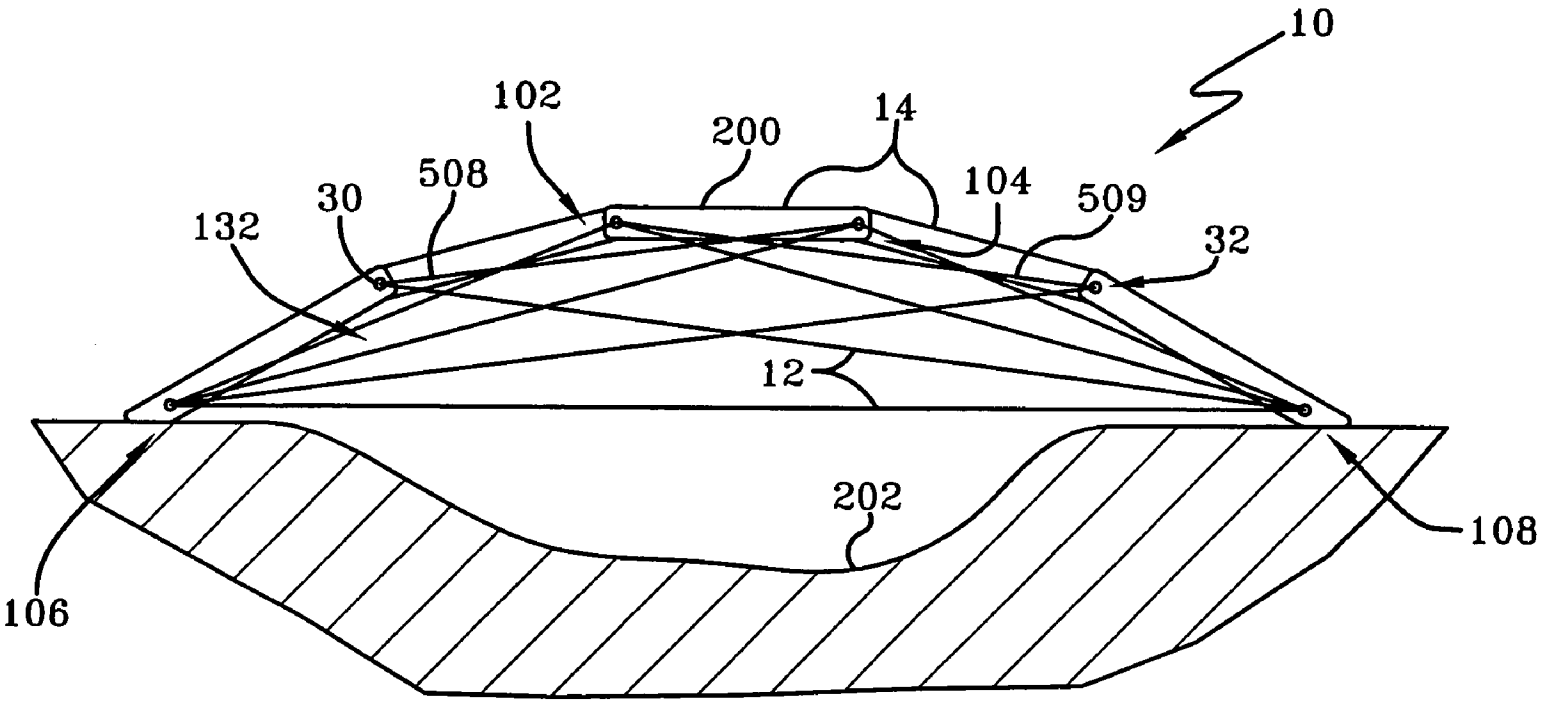
FIG. 1 shows a side plan view of an exemplary embodiment of a bridge.

Referring now to the drawings and particularly to FIG. 1, there is shown therein a side plan view of an exemplary embodiment of a bridge 10. The bridge may include a plurality of cables 12 which extend between a plurality of interconnected segments 14. The resulting arch shape of the bridge includes an upper side that has a substantially convex shape and an opposed lower side that has a substantially concave shape. In exemplary embodiments, the cables extend along the lower side between the ends and/or junctions of the segments and are operative to maintain the bridge in the arched shape and resist downwardly directed forces such as gravity or other forces acting on the bridge from collapsing the bridge.

In an exemplary embodiment, the bridge comprises five segments 14 connected in series. Each segment may include opposed first and second ends 102, 104. Each adjacent pair of segments may be in pivoting connection with each other. In an exemplary embodiment, the end of at least one segment from each adjacent pair of segments may be in pivoting connection with a horizontal rod 30. In further exemplary embodiments, both adjacent ends of an adjacent pair of segments may be in pivoting connection with the rod. In addition, in alternative exemplary embodiments, other linkages or hardware may be used to connect adjacent segments in pivoting connection, such as bolts, hinges, pins and/or flexible devices or materials.

Figure 2:
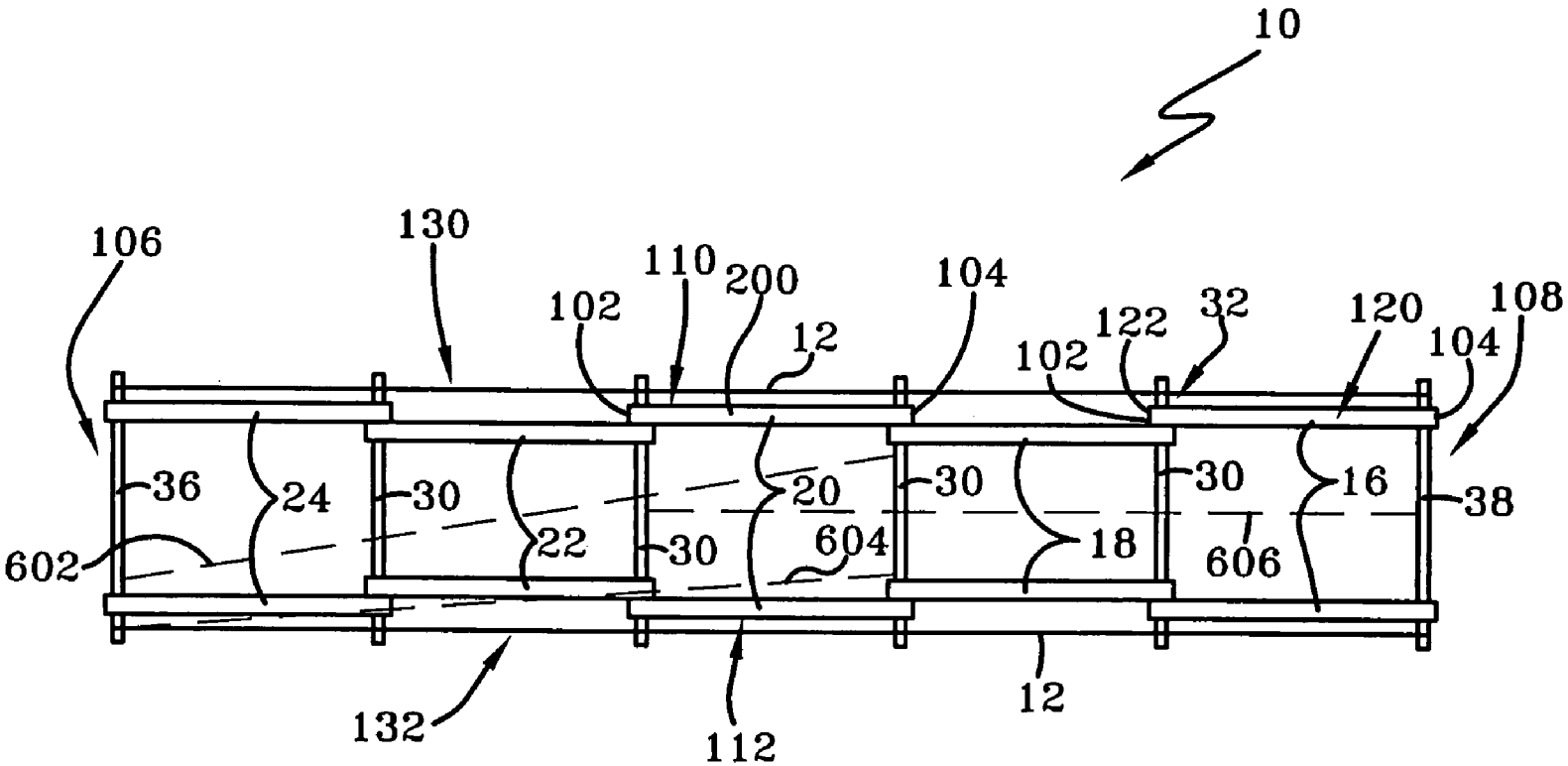
FIG. 2 shows a top plan view of the bridge.

FIG. 2 shows a top plan view of the bridge. In this described exemplary embodiment, the bridge may include rods 30 located at each junction between the ends of adjacent pairs of segments. The series of segments as an interconnected group may further include opposed ends 106 and 108. In an exemplary embodiment, the ends 106 and 108 of the series may be in operative connection with rods 36, 38 as well.

Each segment may include opposed sides 110,112 which extend perpendicular and between the opposed ends 102, 104 of the segment. In exemplary embodiments the rods may extend outwardly from each of the opposed sides 110, 112 of the segments. The cables 12 may be in operative connection with the portions of the rods which extend outwardly from the segments 30. The cables may also be in operative connection with portions of the rods which extend between the opposed sides 110, 112 of the segments. Further, it is to be understood that in alternative exemplary embodiments the cables may be connected to other portions of the bridge adjacent the ends or junctions between segments. For example, the bridge may include hooks, bolts or other fasteners connected adjacent the ends of the segments which are operative to permanently or releasably connect an end of a cable to the end of a segment.

Figure 3:
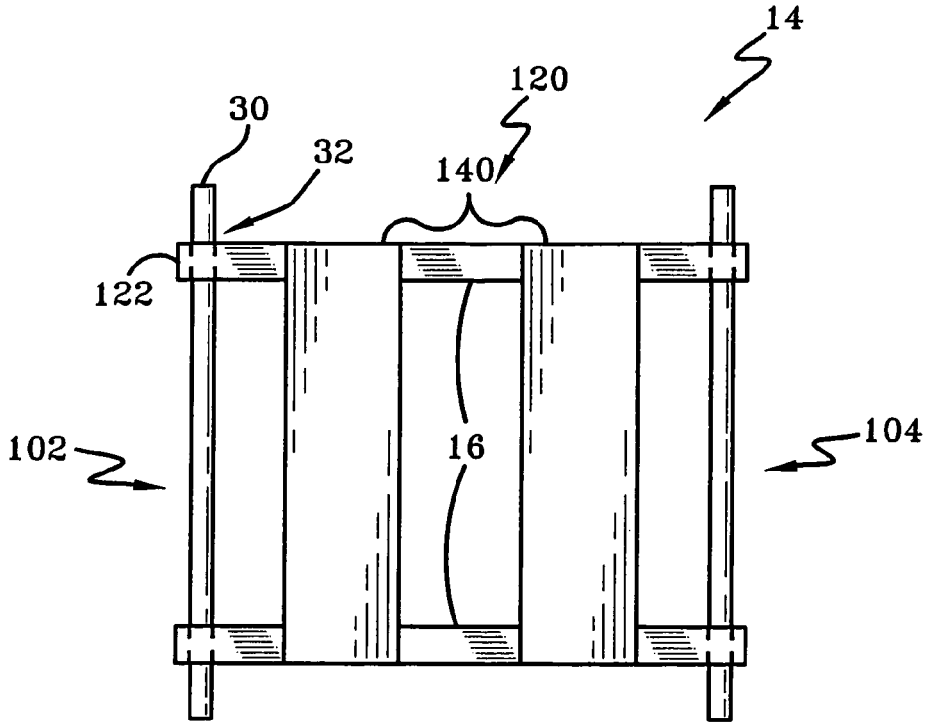
FIG. 3 shows a top plan view of an exemplary embodiment of a segment.

FIG. 3 shows a top plan view of an exemplary embodiment of a segment. In this described exemplary embodiment a segment 14 may be comprised of a pair of parallel beams 16. The ends of each beam may include an aperture 32 for receiving a rod 30 therethrough. As used herein the ends of each segment may include not only the tip 122 of the segment but also portions of the segment between the center 120 of the segment and the end 102 of the segment. Such apertures 32 are inwardly offset from the tip 122 of the end 102 of the segment. However, for purposes of this disclosure and the claims, these apertures are considered to be positioned on the ends of the segments.

Each segment 14 may include one or more planks 140 which span and are connected to the pair of beams 16 of the segment. The planks provide a relatively wide support surface which enables a person or object to cross the bridge. In this described exemplary embodiment, the beams and planks may be comprised out of wood. However, in alternative exemplary embodiments the segments may be formed out of other materials including plastic, metal, or any other material which is sufficiently rigid to form with other segments an arch capable of supporting the weight of itself and one or more persons and objects. It is to be noted that in FIG. 2, the segments are shown without a walking surface such as planks so that the configuration of the beams, rods, and cables can be more easily shown and described.

Referring back to FIG. 2, in exemplary embodiments, the bridge may include two sets of cables with each set comprising at least four cables. A first set 130 of cables may extend adjacent the first sides of the segments. A second set 132 of cables may extend adjacent the second side of the segments. Thus the pattern of cables shown in FIG. 1 may be duplicated on each side of the bridge. However, in alternative exemplary embodiments, the bridge may include only one set of cables. In an alternative exemplary embodiment, a single set of cables may connect to portions of the rods or ends of the segments located between the opposed sides of the segments and under the bridge. Such a single set of cables may be attached to the midpoints of the rods between the sides of the segments. An example of such a cable is shown with the dashed line 606 shown in FIG. 2.

Also in alternative exemplary embodiments, a first end of a cable may be mounted adjacent the first side of a segment, and the second end of the cable may be mounted adjacent the second side of a different segment. As a result, the cables may by mounted diagonally and/or may extend between the first and second sides of the bridge. An example of such a diagonal cable is shown as a dashed line 602 in FIG. 2.

In exemplary embodiments, the cables may include fasteners mounted to the ends of the cables which enable the cables to be securely mounted to the rods, segment ends or other portions of the bridge adjacent the ends of the segments. In exemplary embodiments the rods may be threaded. Bolts, washers and/or other fasteners may be mounted to the rods to prevent the rods from sliding out of engagement with the segments. The bolts, washers, and other fasteners may also be used to prevent the cables from sliding out of engagement with the ends of the segments. For example, in an exemplary embodiment, each end of a cable may be curled into a loop which is connected back to the cable. Such a loop may be secured in place using a U-clamp or other fastener. The rod may extend through the loop to connect the end of the cable to the end of a segment and/or a junction between segments. Washers and/or bolts connected to the rods may be positioned adjacent the cable ends to prevent the cables from sliding relative to and/or off of the rods.

As discussed previously, each of the segments 14 may be comprised of a pair of parallel beams 16–24. Three of the segments 16, 20, 24 may have a relatively wider separation between beams of the segments than two of the pairs 22, 18. When linked together in overlapping relation, the pairs of beams of the segments are connected in a pattern of alternating wide and narrow orientated pairs of beams.

In alternative exemplary embodiments, a set of cables may remain adjacent a common side of the bridge; however, the ends of the cables for the set may be connected to opposed sides of the beams of the segments for a side of the bridge. An example of such a cable is shown as a dashed line 604 in FIG. 2. In exemplary embodiments, the cables may be comprised of stainless steel strands or other material, such as nylon or any other flexible material which is sufficiently strong to maintain the bridge in the arch shape shown in FIG. 1 and prevent the bridge from collapsing onto itself in response to downwardly directed forces.

Figure 4:
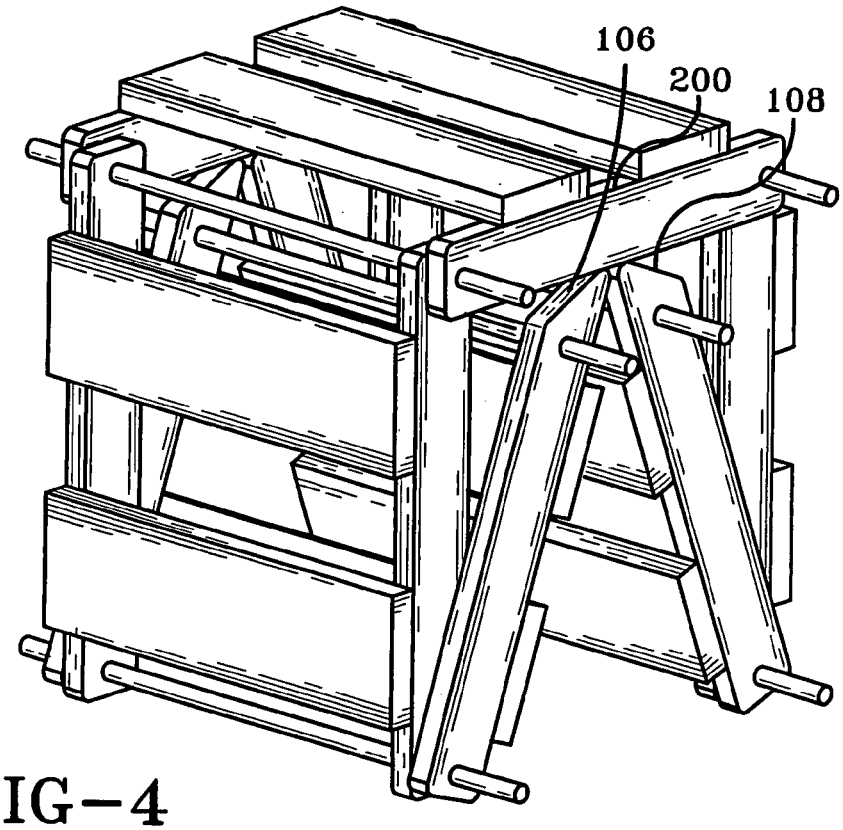
FIG. 4 shows a perspective view of the bridge in a compacted configuration.

In an exemplary embodiment, the bridge is adapted to be portable before and/or after it is erected. To move the bridge, the segments at the ends 106, 108 of the bridge, may be pivoted inwardly which provides slack in the cables. The segments may then be rotated with respect to each other as shown in FIG. 4 to place the bridge into a compacted configuration. Here the ends 106, 108 of the bridge have been moved adjacent each other and adjacent the center segment 200.

The resulting compacted configuration of the bridge corresponds to box. In an exemplary embodiment, the dimensions of the segments may be such that the compacted configuration of the bridge is operative to fit within a bed of a pickup truck, which bed is adapted to hold a four foot by eight foot sheet of plywood. For example, the segments may have lengths of at least three feet and widths of at least two feet. The rods may have lengths greater than the widths of the segments. In the described exemplary embodiment the rods may be three feet in length. As a result when in the compacted configuration, the described exemplary embodiment of the bridge may have a rectangular box-like or cube shape with a width, length, and depth of about three feet. Also, in exemplary embodiments, the cables may be removed or left on the bridge when it is being moved.

When the bridge is pivoted to the arch configuration shown in FIG. 1, the bridge may span at least ten feet and have a walking surface with a width of at least two feet. Also, with five segments, the angles between adjacent segments may be between 110 and 160 degrees. For example in the described exemplary embodiment, the angles between adjacent segments may be about 150 degrees.

In exemplary embodiments, the end segments 106, 108 of the bridge 10 are in contact with the ground 202 and may be orientated to extend at acute angles with respect to level portions of the ground surface. For example in an exemplary embodiment, the end segments may be orientated at about forty-five degree angles with respect to a horizontal plan extending between the tips of the end segments. In other exemplary embodiments the end segments may extend upwardly from the ground at other acute angles depending on the length and height of the arch of the bridge. In addition, it is to be understood that in alternative exemplary embodiments, other angles between adjacent segments may be used to provide for shorter/higher or longer/lower configurations of the arch. Also, in other exemplary embodiments, the segments as a group or individually may have other lengths or widths to provide for larger or smaller configurations of the bridge.

In addition, when the bridge 10 is erected into the arched configuration shown in FIG. 1 with the middle segment 200 positioned a distance above the ends 106, 108 of the bridge, each of the cables is taut and substantially straight. However, it is to be understood that even though the cables may be taut, gravity may be operative to cause the cables to bow slightly downwardly between ends of the segments. As used herein the term substantially straight is intended to include cables which are fully extended into a generally straight and taut line but may have a relatively small downward deflection as a result of gravity.

Figure 5:
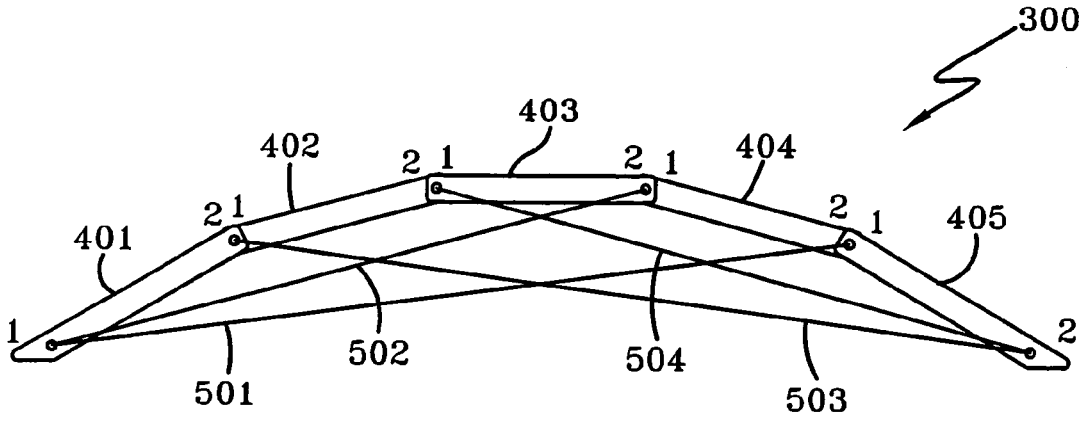
FIG. 5 shows a side plan view of a configuration of cables on an exemplary embodiment of the bridge.

FIG. 5 shows an alternative exemplary configuration of cables for a bridge 300. The bridge 300 comprises five segments connected in series as discussed previously. Each segment includes first and second opposed ends. In this described embodiment, the second end of the first segment 401 is in pivoting connection with the first end of the second segment 402. The second end of the second segment 402 is in pivoting connection with the first end of the third segment 403. The second end of the third segment 403 is in pivoting connection with the first end of the fourth segment 404. Also, the second end of the fourth segment 404 is in pivoting connection with the first end of the fifth segment 405.

In this described exemplary embodiment, at least one first cable 501 extends between a portion of the bridge adjacent the first end of the first segment 401 and a portion of the bridge adjacent a junction between the second end of the fourth segment 404 and the first end of the fifth segment 405. At least one second cable 502 extends between a portion of the bridge adjacent the first end of the first segment 401 and a portion of the bridge adjacent a junction between the second end of the third segment 403 and the first end of the fourth segment 404. At least one third cable 503 extends between a portion of the bridge adjacent the second end of the fifth segment 405 and a portion of the bridge adjacent a junction between the second end of the first segment 401 and the first end of the second segment 402. In addition at least one fourth cable 504 extends between a portion of the bridge adjacent the second end of the fifth segment 405 and a portion of the bridge adjacent a junction between the second end of the second segment 402 and the first end of the third segment 403.

In this described exemplary embodiment, when the segments are pivoted to an orientation which forms an upwardly bowed arch, a portion of each of the cables becomes taut and extends in a substantially straight line between the portions of the bridge. As a result the cables are operative to resist downwardly directed forced acting on the segments from causing the arch to collapse.

Also, in this described embodiment, the portions of the bridge adjacent the ends of the segments to which the cables are connected may correspond to the previously described rods. However, it is to be understood that these portions of the bridge adjacent the ends of the segments may also correspond to the brackets, bolts or other fasteners in operative connection with the ends of the segments and/or junction between segments.

In addition, the ends of the cables may include loops. It is to be understood that the described portion of the cables which are substantially straight when pulled taut by the segments, may not include the loops at the ends of the cables which may remain rounded or curved rather than straight.

Figure 6:
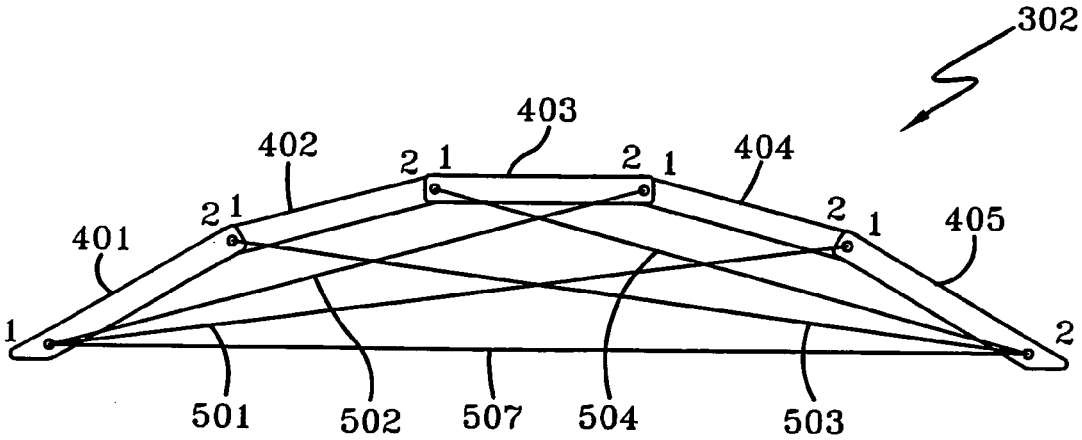
FIG. 6 shows a side plan view of a further configuration of cables on an exemplary embodiment of the bridge.

FIG. 6 shows an alternative exemplary embodiment of a bridge 302 which includes additional cables in operative connection between the ends of different segments of the bridge. Here the bridge includes one, two or more sets of the four cables 501–504 discussed previously with respect to FIG. 5. In addition the bridge includes at least one fifth cable 507 which extends between a portion of the bridge adjacent the first end of the first segment 401 and a portion of the bridge adjacent the second end of the fifth segment 405.

Figure 7:
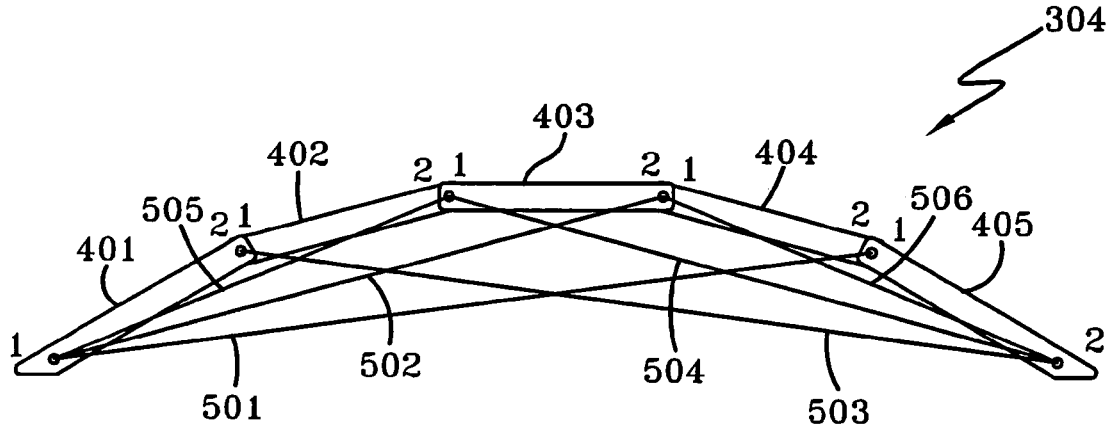
FIG. 7 shows a side plan view of a further configuration of cables on an exemplary embodiment of the bridge.

FIG. 7 shows a further alternative exemplary embodiment of a bridge 304 which includes additional cables in operative connection between the ends of different segments of the bridge. Here the bridge includes one, two, or more sets of the four cables 501–504 discussed previously with respect to FIG. 5. In addition the bridge includes at least one fifth cable 505 which extends between a portion of the bridge adjacent the first end of the first segment 401 and a portion of the bridge adjacent a junction between the second end of the second segment 402 and the first end of the third segment 403. In addition the bridge includes at least one sixth cable 506 which extends between a portion of the bridge adjacent the second end of the fifth segment 405 and a portion of the bridge adjacent a junction between the second end of the third segment 403 and the first end of the fourth segment 404.

Figure 8:
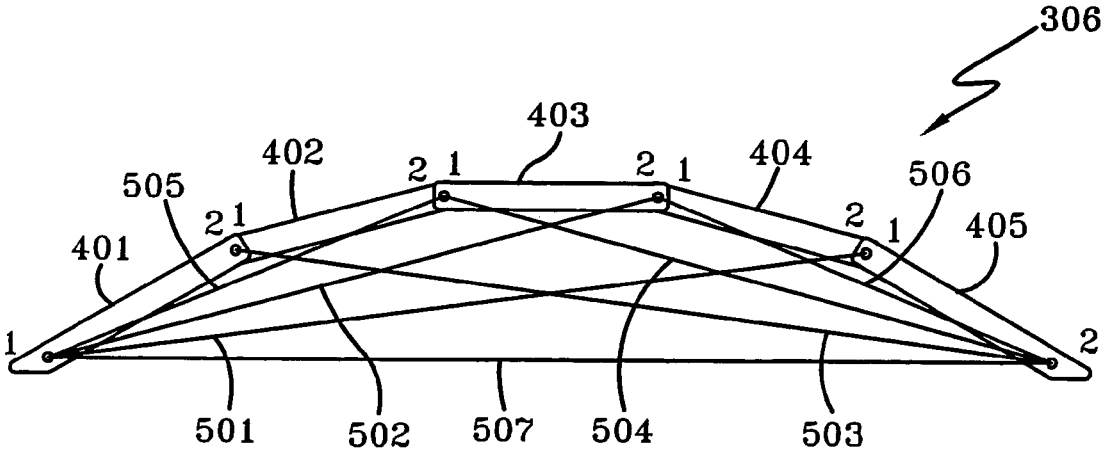
FIG. 8 shows a side plan view of a further configuration of cables on an exemplary embodiment of the bridge.

FIG. 8 shows a further alternative exemplary embodiment of a bridge 306. Here the bridge includes the one, two, or more sets of six cables 501–506 discussed previously with respect to FIG. 7. In addition the bridge includes at least one seventh cable 507 which extends between a portion of the bridge adjacent the first end of the first segment 401 and a portion of the bridge adjacent the second end of the fifth segment 405.

Other exemplary embodiments of the bridge may include additional cables. For example the bridge 10 shown in FIG. 1 includes the pattern of cables shown in FIG. 8 and two additional cables 508, 509.

As discussed previously, exemplary embodiments may include only one set of cables such as one set of four cables (configured as shown in FIG. 5), one set of five cables (configured as shown in FIG. 6), one set of six cables (configured as shown in FIG. 7), one set of seven cables (configured as shown in FIG. 8) or one set of nine cables (configured as shown in FIG. 1). However, as discussed previously, exemplary embodiments may include two or more sets of cables where each set is configured as shown and described with respect to FIGS. 1, and 5–8. For example, as shown in FIG. 2, the different sets may be positioned adjacent each side of the bridge. However, in alternative exemplary embodiments the different sets of cables may cross each other and extend diagonally between opposite sides of the bridge or between opposite sides of the beams of a segment.

The previously described exemplary embodiments have been shown with five segments in series. However, in alternative exemplary embodiments, bridges may include more or less segments connected in series. As described previously, the segments of these alternative exemplary embodiments may pivot between a compacted configuration and an upwardly bowed arched configuration. Also as discussed previously, cables extending below the lower side of such alternative exemplary embodiments of the bridge may maintain the bridge in the arched configuration.

Thus the new bridge achieves one or more of the above stated objectives, eliminates difficulties encountered in the use of prior devices and systems, solves problems and attains the desirable results described herein.

In the foregoing description certain terms have been used for brevity, clarity and understanding, however no unnecessary limitations are to be implied therefrom because such terms are used for descriptive purposes and are intended to be broadly construed. Moreover, the descriptions and illustrations herein are by way of examples and the invention is not limited to the exact details shown and described.

In the following claims any feature described as a means for performing a function shall be construed as encompassing any means known to those skilled in the art to be capable of performing the recited function, and shall not be limited to the features and structures shown herein or mere equivalents thereof. The description of the exemplary embodiment included in the Abstract included herewith shall not be deemed to limit the invention to features described therein.

Having described the features, discoveries and principles of the invention, the manner in which it is constructed and operated, and the advantages and useful results attained; the new and useful structures, devices, elements, arrangements, parts, combinations, systems, equipment, operations, methods and relationships are set forth in the appended claims.

We claim:

1. A bridge comprising:

at least five segments connected in series, wherein each segment includes two opposed ends, wherein the ends of adjacent segments are in pivoting connection with respect to each other;

at least four cables each having opposed ends, wherein for each end of each segment, each respective opposed end of at least one cable is in respective operative connection with the end of the segment and at least one end of at least one other segment;

wherein when the segments are pivoted to an orientation which forms an upwardly bowed arch, each of the cables extends substantially taut in operative connection with the ends of different segments, whereby the cables are operative to resist downwardly directed force acting on the segments from causing the arch to collapse.

2. The bridge according to claim 1, wherein when the segments are pivoted to the orientation which forms the upwardly bowed arch, substantially all of each cable extends in a substantially straight line between portions of the bridge adjacent the ends of different segments.

3. The bridge according to claim 1, wherein when the segments are pivoted to the orientation which forms the upwardly bowed arch, adjacent segments are oriented at angles less than 160 degrees and greater than 110 degrees with respect to each other.

4. The bridge according to claim 3, wherein adjacent segments are operative to pivot in directions which decrease the angles with respect to each other and form slack in the cables.

5. The bridge according to claim 3, wherein adjacent segments are operative to pivot in directions which decrease the angles with respect to each other and place segments at the ends of the series adjacent to each other.

6. The bridge according to claim 1, further comprising at least one rod at each junction between adjacent segments, wherein at least one segment of each adjacent set of segments is in pivoting connection with the rod.

7. The bridge according to claim 6, wherein the cables are in operative connection with the rods.

8. The bridge according to claim 1, wherein each segment includes opposed first and second side ends which extend between the opposed ends of the segment, wherein the plurality of cables includes at least eight cables, wherein a first set of at least four of the cables is in operative connection with the segments adjacent the first side ends of the segments, wherein a second set of at least four of the cables is in operative connection with the segments adjacent the second side ends of segments.

9. The bridge according to claim 1, wherein when the segments are pivoted to the orientation which forms the upwardly bowed arch, the segments provide a walking surface which is adapted to support at least one person walking thereon.

10. The bridge according to claim 1, wherein the at least five segments each include first and second opposed ends, wherein the second end of the first segment is in pivoting connection with the first end of the second segment, wherein the second end of the second segment is in pivoting connection with the first end of the third segment, wherein the second end of the third segment is in pivoting connection with the first end of the fourth segment, wherein the second end of the fourth segment is in pivoting connection with the first end of the fifth segment, wherein at least one first cable extends between a portion of the bridge adjacent the first end of the first segment and a portion of the bridge adjacent a junction between the second end of the fourth segment and the first end of the fifth segment, wherein at least one second cable extends between a portion of the bridge adjacent the first end of the first segment and a portion of the bridge adjacent a junction between the second end of the third segment and the first end of the fourth segment, wherein at least one third cable extends between a portion of the bridge adjacent the second end of the fifth segment and a portion of the bridge adjacent a junction between the second end of the first segment and the first end of the second segment, wherein at least one fourth cable extends between a portion of the bridge adjacent the second end of the fifth segment and a portion of the bridge adjacent a junction between the second end of the second segment and the first end of the third segment.

11. An apparatus comprising:

a bridge, wherein the bridge comprises at least five segments connected in series, wherein each segment includes first and second opposed ends, wherein the second end of the first segment is in pivoting connection with the first end of the second segment, wherein the second end of the second segment is in pivoting connection with the first end of the third segment, wherein the second end of the third segment is in pivoting connection with the first end of the fourth segment, wherein the second end of the fourth segment is in pivoting connection with the first end of the fifth segment;

a plurality of cables, wherein at least one first cable extends between a portion of the bridge adjacent the first end of the first segment and a portion of the bridge adjacent a junction between the second end of the fourth segment and the first end of the fifth segment, wherein at least one second cable extends between a portion of the bridge adjacent the first end of the first segment and a portion of the bridge adjacent a junction between the second end of the third segment and the first end of the fourth segment, wherein at least one third cable extends between a portion of the bridge adjacent the second end of the fifth segment and a portion of the bridge adjacent a junction between the second end of the first segment and the first end of the second segment, wherein at least one fourth cable extends between a portion of the bridge adjacent the second end of the fifth segment and a portion of the bridge adjacent a junction between the second end of the second segment and the first end of the third segment; and wherein when the segments are pivoted to an orientation which forms an upwardly bowed arch, each of the cables extends substantially taut in operative connection with the ends of different segments, whereby the cables are operative to resist downwardly directed forces acting on the segments from causing the arch to collapse.

12. The bridge according to claim 11, wherein at least one fifth cable extends between a portion of the bridge adjacent the first end of the first segment and a portion of the bridge adjacent the second end of the fifth segment.

13. The bridge according to claim 11, wherein at least one fifth cable extends between a portion of the bridge adjacent the first end of the first segment and a portion of the bridge adjacent a junction between the second end of the second segment and the first end of the third segment, wherein at least one sixth cable extends between a portion of the bridge adjacent the second end of the fifth segment and a portion of the bridge adjacent a junction between the second end of the third segment and the first end of the fourth segment.

14. The bridge according to claim 13, wherein at least one seventh cable extends between a portion of the bridge adjacent the first end of the first segment and a portion of the bridge adjacent the second end of the fifth segment.

15. The bridge according to claim 14, wherein the cables have predetermined lengths, such that when the segments are pivoted to an orientation which forms an upwardly bowed arch, portions of each of the at least one first, second, third, fourth, fifth, sixth, and seventh cables extend in substantially straight lines between the portions of the bridge.

16. A method comprising:

a) providing a bridge comprising at least five segments linked in a series, wherein each segment includes two opposed ends, wherein the ends of adjacent segments are in pivoting connection with respect to each other, wherein the bridge further comprises a plurality of cables each having opposed ends, wherein for each end of each segment, each respective opposed end of at least one cable is in respective operative connection with the end of the segment and at least one end of at least one other segment, wherein a portion of each cable is substantially slack;

b) pivoting the segments to form an arch, wherein opposed ends of the series of segments are adjacent the ground and a central portion of the series of segments bows upwardly above the ground;

c) responsive to (b), urging with the segments, each of the portions of the cables to extend substantially taut between portions of the bridge adjacent the ends of the segments.

17. The method according to claim 16, where in (a) the segments are orientated in a compacted configuration with the opposed ends of the series of segments positioned adjacent to each other.

18. The method according to claim 17, further comprising:

d) pivoting the segments to return the bridge to the compacted configuration.

19. The method according to claim 18, wherein in (c) the bridge includes an upper side that has a substantially convex shape and an opposed lower side that has a substantially concave shape, wherein the cables extend along the lower side.

20. The method according to claim 16, wherein in (c) substantially all of each cable extends in a substantially straight line between portions of the bridge adjacent the ends of different segments.

* * * * *